US008459362B2

(12) United States Patent
Ceccarelli et al.

(10) Patent No.: US 8,459,362 B2
(45) Date of Patent: Jun. 11, 2013

(54) SYSTEM, DEVICE, AND METHOD OF INSTALLATION OF A PUMP BELOW A FORMATION ISOLATION VALVE

(75) Inventors: Tomaso U. Ceccarelli, Kuala Lumpur (MY); Timo W. J. M. Staal, Gadong (BN)

(73) Assignee: Schlumberger Technology Corporation, Sugar Land, TX (US)

( * ) Notice: Subject to any disclaimer, the term of this patent is extended or adjusted under 35 U.S.C. 154(b) by 399 days.

(21) Appl. No.: 12/813,639

(22) Filed: Jun. 11, 2010

(65) Prior Publication Data

US 2011/0005772 A1 Jan. 13, 2011

Related U.S. Application Data

(60) Provisional application No. 61/186,209, filed on Jun. 11, 2009.

(51) Int. Cl.
*E21B 43/00* (2006.01)
*E21B 27/00* (2006.01)

(52) U.S. Cl.
USPC ..... 166/372; 166/106; 166/107

(58) Field of Classification Search
USPC 166/372, 106, 117, 157, 373, 107; 417/410.1
See application file for complete search history.

(56) References Cited

U.S. PATENT DOCUMENTS

| | | | | |
|---|---|---|---|---|
| 3,532,164 | A | 10/1970 | Enright | |
| 4,350,205 | A * | 9/1982 | Goldschild et al. | 166/375 |
| 4,440,221 | A * | 4/1984 | Taylor et al. | 166/106 |
| 4,688,593 | A | 8/1987 | Pringle | |
| 5,097,902 | A | 3/1992 | Clark | |
| 5,220,962 | A | 6/1993 | Muller et al. | |
| 6,328,111 | B1 * | 12/2001 | Bearden et al. | 166/381 |
| 6,352,113 | B1 * | 3/2002 | Neuroth | 166/301 |
| 6,354,378 | B1 * | 3/2002 | Patel | 166/374 |
| 6,457,521 | B1 * | 10/2002 | Langseth et al. | 166/264 |
| 6,848,510 | B2 | 2/2005 | Bixenman | |
| 7,086,473 | B1 * | 8/2006 | Bangash | 166/372 |
| 7,228,914 | B2 * | 6/2007 | Chavers et al. | 166/386 |
| 7,413,009 | B2 | 8/2008 | Jacobs et al. | |
| 7,428,924 | B2 * | 9/2008 | Patel | 166/250.01 |
| 7,533,729 | B2 | 5/2009 | Rogers et al. | |
| 7,896,079 | B2 * | 3/2011 | Dyer et al. | 166/306 |
| 2002/0050361 | A1 * | 5/2002 | Shaw et al. | 166/380 |
| 2005/0095156 | A1 | 5/2005 | Wolters et al. | |
| 2005/0205302 | A1 | 9/2005 | Meister et al. | |
| 2007/0295504 | A1 * | 12/2007 | Patel | 166/263 |
| 2008/0029274 | A1 * | 2/2008 | Rytlewski et al. | 166/375 |
| 2008/0093084 | A1 * | 4/2008 | Knight et al. | 166/369 |
| 2008/0202748 | A1 * | 8/2008 | Bussear et al. | 166/264 |
| 2009/0211755 | A1 * | 8/2009 | Dyer et al. | 166/252.1 |
| 2009/0301732 | A1 * | 12/2009 | Turner et al. | 166/374 |
| 2010/0122818 | A1 * | 5/2010 | Rooks | 166/369 |

OTHER PUBLICATIONS

Ceccarelli et al., International Search Report dated Jul. 27, 2010 from International Application No. PCT/US2010/038261 filed Jun. 11, 2010.

* cited by examiner

*Primary Examiner* — Giovanna Wright
*Assistant Examiner* — Michael Wills, III
(74) *Attorney, Agent, or Firm* — Jim Patterson

(57) ABSTRACT

Systems, devices, and methods of producing a fluid include a pump assembly that operates to increase the hydrostatic pressure of the fluid. The pump assembly is located in a well completion below a formation isolation valve. The pump assembly releasably connects to a polished bore receptacle in the well completion.

19 Claims, 3 Drawing Sheets

SYSTEM, DEVICE, AND METHOD OF INSTALLATION OF A PUMP BELOW A FORMATION ISOLATION VALVE

CROSS REFERENCE TO RELATED APPLICATION

This application relates to and claims priority from U.S. Provisional Application Ser. No. 61/186,209 filed on Jun. 11, 2009, which is herein incorporated by reference in its entirety.

TECHNICAL FIELD

The present disclosure relates generally to fluid pumps, and more particularly to the use of fluid pumps downhole below a formation isolation valve.

BACKGROUND

Electric motors are often placed downhole in an oil or gas field to perform a variety of functions. These functions can include the generation of artificial lift, whereby the electrical motor drives a fluid pump that is used to increase hydrostatic pressure to bring downhole fluids to the surface.

BRIEF DISCLOSURE

The present disclosure is related to the placement of a pump assembly downhole below a formation isolation valve. In an embodiment of a system for producing a fluid, the system includes a formation isolation valve located in a completion and above a production interval of a well. A shroud assembly is located in the completion below the formation isolation valve and adjacent or below the production interval. A pump assembly releasably connects with the shroud assembly such that the pump assembly is at least partially disposed within the shroud assembly and the shroud assembly extends downhole past an electric motor of the pump assembly.

An embodiment of a pump assembly disclosed herein includes a ported seal assembly configured to engage a polished bore receptacle of a well completion to form a fluid seal between the ported seal assembly and the polished bore receptacle. A locking assembly is connected to the ported seal assembly. The locking assembly is configured to releasably engage the polished bore receptacle of the well completion to releasably secure the electric pump to the polished bore receptacle. A fluid pump is connected below the ported seal assembly. An electric motor is connected below the fluid pump. The electric motor is operatively connected to the fluid pump to provide actuation of the fluid pump. A shifting tool is connected below the electric motor. A power cable extends through the ported seal assembly and connects to the electric motor to provide energization to the electric motor.

A method of producing fluid from a hydrocarbon formation includes locating a polished bore receptacle downhole at a location adjacent or below a production interval of the hydrocarbon formation. A formation isolation valve is located downhole above the polished bore receptacle and above the production interval. The formation is isolated by closing the formation isolation valve. A pump assembly is lowered downhole. The formation isolation valve is opened with a shifting tool of the pump assembly. The pump assembly is passed through the formation isolation valve. The pump assembly is releasably connected within the polished bore receptacle.

BRIEF DESCRIPTION OF THE DRAWINGS

Certain embodiments of the disclosure will hereafter be described with reference to the accompanying drawings, wherein like reference numerals denote like elements, and.

DETAILED DISCLOSURE

In the following description, numerous details are set forth to provide an understanding of the various embodiments. However, it will be understood by those skilled in the art that those embodiments presented may be practiced without these details and that numerous variations or modifications from the described embodiments may be possible. Also, it should be understood by one skilled in the art that the descriptions herein do not limit any present or subsequent related claims.

In the specification and appended claims, the terms "connect", "connection", "connected", "in connection with", and "connecting" are used to mean "in direct connection with" or "in connection with via another element"; and the "set" is used to mean "one element" or "more than one element". As used herein, the terms "up" and "down", "upper" and "lower", "upwardly" and "downwardly", "upstream" and "downstream", "above" and "below", and other like terms indicating relative positions above or below a given point or element are used in this description to more clearly describe some embodiments. However, when applied to equipment and methods for use in wells that are deviated or horizontal, such terms may refer to a left to right, right to left, or other relationship as appropriate. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids through the wellbore. Furthermore, the term "treatment fluid" includes fluid delivered to a formation to stimulate production including, but not limited to fracing fluid, acid, gel, foam or other stimulating fluid.

The present disclosure relates to the operation of a pump assembly below a formation isolation valve (FIV) existing as part of a well completion. The pump assembly may include an electric submersible pump (ESP) or a progressive cavity pump (PCP), or any other type of fluid pump as would be recognized as suitable by one of ordinary skill in the art. In the present disclosure, the pump assembly will be described in greater detail herein with respect to an embodiment with an electric submersible pump (ESP).

Figure 1:
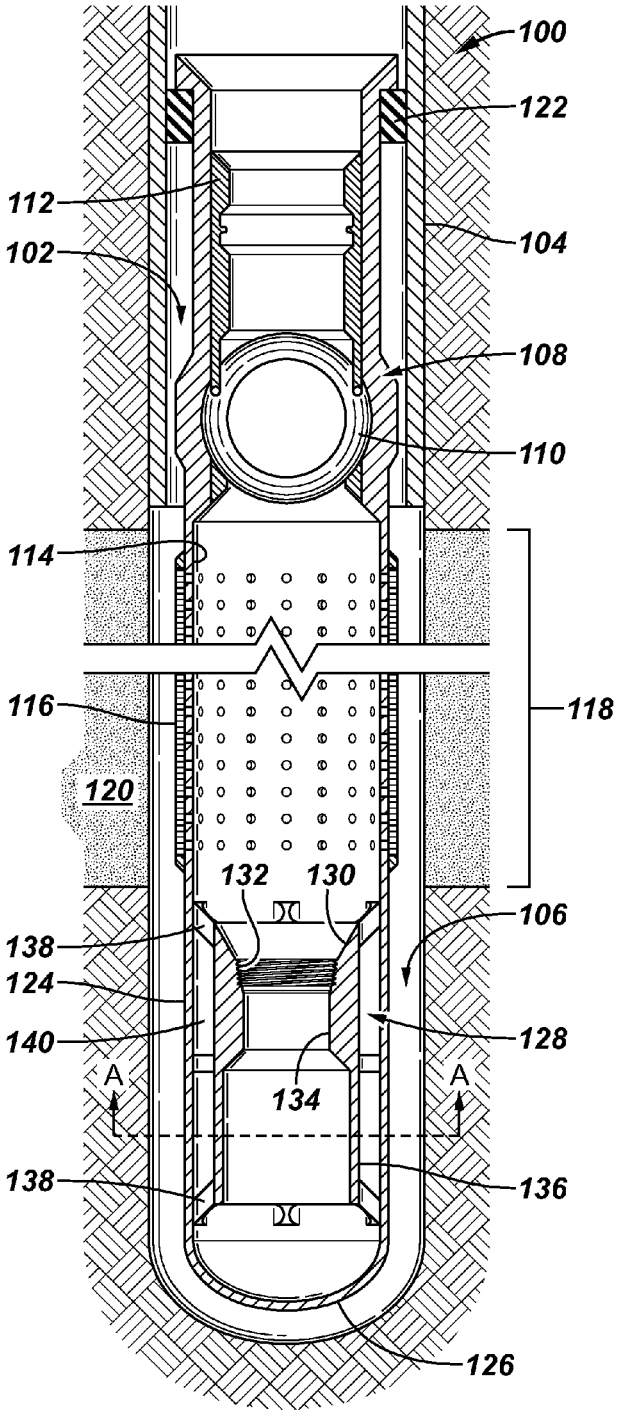
FIG. 1 is an elevation view of a completion deployed in a wellbore.

FIG. 1 is an elevation view of a completion 100 deployed in a wellbore, a portion of the wellbore is a cased wellbore 102 lined with a casing 104, which may be of concrete. Another portion of the wellbore is an open wellbore 106. While FIG. 1 depicts the completion 100 located partially within the cased wellbore 102 and partially within the open wellbore 106, it is understood that embodiments disclosed herein may be alternatively implemented in cased wellbores or open wellbores.

The completion 100 includes a formation isolation valve (FIV) 108. An example of a suitable FIV is any FIV of those commercially available from Schlumberger, Ltd. The FIV 108 includes a ball valve 110. The ball valve 110 is operable between an open position and a closed position. The ball valve 110 is depicted in the closed position in FIG. 1. The ball valve 110 is actuated by translational movement of a collet 112 within the FIV 108. The collet 112 travels between an uppermost position, as depicted in FIG. 1, wherein the ball valve 110 is in the closed position and a lowermost position (depicted in FIG. 2) wherein the ball valve 110 is rotated into an open position.

The FIV 108 functions to isolate a hydrocarbon bearing formation 120. This prevents any unnecessary fluid loss, and also secures the well against a blowout. Typically, when a wellbore is drilled, the formation 120 is coated with filter cake (not depicted) that initially prevents fluid loss. However, the filter cake is mechanically or chemically removed to produce the well. Therefore, after production has started, the FIV 108 is required to suspend production and to isolate the formation 120 from fluid loss or fluid intake.

The completion 100 further includes production tubing 114. The production tubing 114 may be perforated tubing. The production tubing 114 may include a sand screen 116. The production tubing 114 is generally aligned within the open wellbore 106 adjacent a production interval 118 of the hydrocarbon bearing formation 120. The production tubing 114 and the sand screen 116 permit the production of fluid from the formation 120 while preventing excess debris from being produced with the fluid.

The production tubing 114 and sand screen 116 are suspended in the completion 100 by a screen hanger packer 122 that expands to hold the completion 100 within the cased wellbore 102. One or more sections of blank pipe 124 are connected below the production tubing 114 and screen 116. The blank pipe 124 may be connected to the production tubing 114 with a threaded connection. The blank pipe 124 terminates in a bull-nose plug 126, which is also threadedly connected to the blank pipe 124. While a single section of blank pipe 124 is depicted as being connected between the production tubing 114 and the bull-nose 126, it is understood that a plurality of blank pipe sections 124 may be used in alternative embodiments. Alternative embodiments may also connect the FIV 108 to the production tubing 114 with one or more sections of blank pipe 124 in order to locate the production tubing 114 adjacent the production interval 118.

A shroud assembly 128 is secured in the completion 100 at a position below the production interval 118. However, it is understood that in alternative embodiments, the shroud assembly 128 may be located adjacent the production interval 118, such as coaxially positioned within the production tubing 114 or partially adjacent the production interval 118 and partially below the production interval 118.

The shroud assembly 128 includes a scoop head 130, a latch profile 132, a polished bore receptacle (PBR) 134, and a shroud 136. The shroud assembly 128 is connected to the blank pipe 124 by one or more supports 138 that extend radially outward from the shroud assembly 128 and engage the blank pipe 124. In a non-limiting embodiment, the one or more supports 138 threadedly engage the blank pipe 124. The one or more supports 138 space the shroud assembly 128 coaxially within the blank pipe 124. The shroud assembly and the blank pipe 124 therefore define an annular flow area 140 that will be described in greater detail herein.

The shroud assembly 128 is constructed to have an outside diameter such as to fit within the blank pipe 124. In an exemplary embodiment, the blank pipe 124 has an inside diameter of 6⅝ inches and the shroud assembly 128 has an outside diameter of 5½ inches. It is to be further noted that the outside diameter of the shroud assembly 128 is greater than the inside diameter of the FIV 108. In the exemplary embodiment, the FIV 108 may have an inside diameter of 4.56 inches.

The scoop head 130 is an annular component at the top of the shroud assembly 128. The scoop head 130 is angled downwardly toward the interior of the shroud assembly 128. The scoop head 130 is therefore in the shape of a funnel or frustum that opens to an open interior of the PBR 134, as will be described in further detail herein. The latch profile 132, may be a component of the PBR 134. In an embodiment, the latch profile 132 is a series of milled threads such as to receive a threaded connection.

An example of a suitable PBR to be used in connection with the embodiment is any of a variety of PBRs commercially available from Schlumberger, Ltd. The PBR 134 includes a smooth open interior, with an exemplary inside diameter of 4½ inches.

The shroud 136 may be constructed of one or more pipe segments that are threadably connected to each other and to the PBR 134. In an exemplary embodiment, the shroud 136 has an inside diameter of 4.767 inches. The supports 138 extend from the shroud 136 and engage the blank pipe 124. In one embodiment, the supports 138 are threadedly connected between pipe segments of the shroud 136.

In an embodiment, the shroud assembly 128 is constructed from a single piece of machined metal. In this embodiment, the scoop-head 130, latch profile 132, PBR 134, shroud 136, and at least one support 138 are all integrally formed in the shroud assembly 128. As would be recognized by one of ordinary skill, alternative embodiments may construct the shroud assembly 128 from a plurality of separate components.

Figure 2:
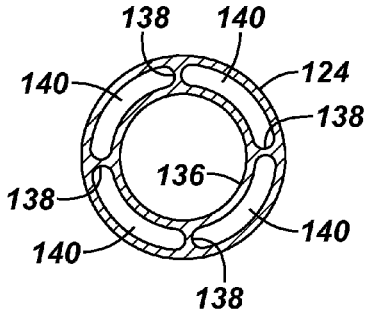
FIG. 2 is a cross section of the completion of FIG. 1 at line A-A.

FIG. 2 is a cross sectional view of the completion 100 taken along the line A-A. The cross sectional view of FIG. 2 shows that a plurality of annular flow areas 140 are created between the coaxially aligned shroud 136 and blank pipe 124. The size and the dimensions of the annular flow area 140 are defined by the supports 138.

Figure 3:
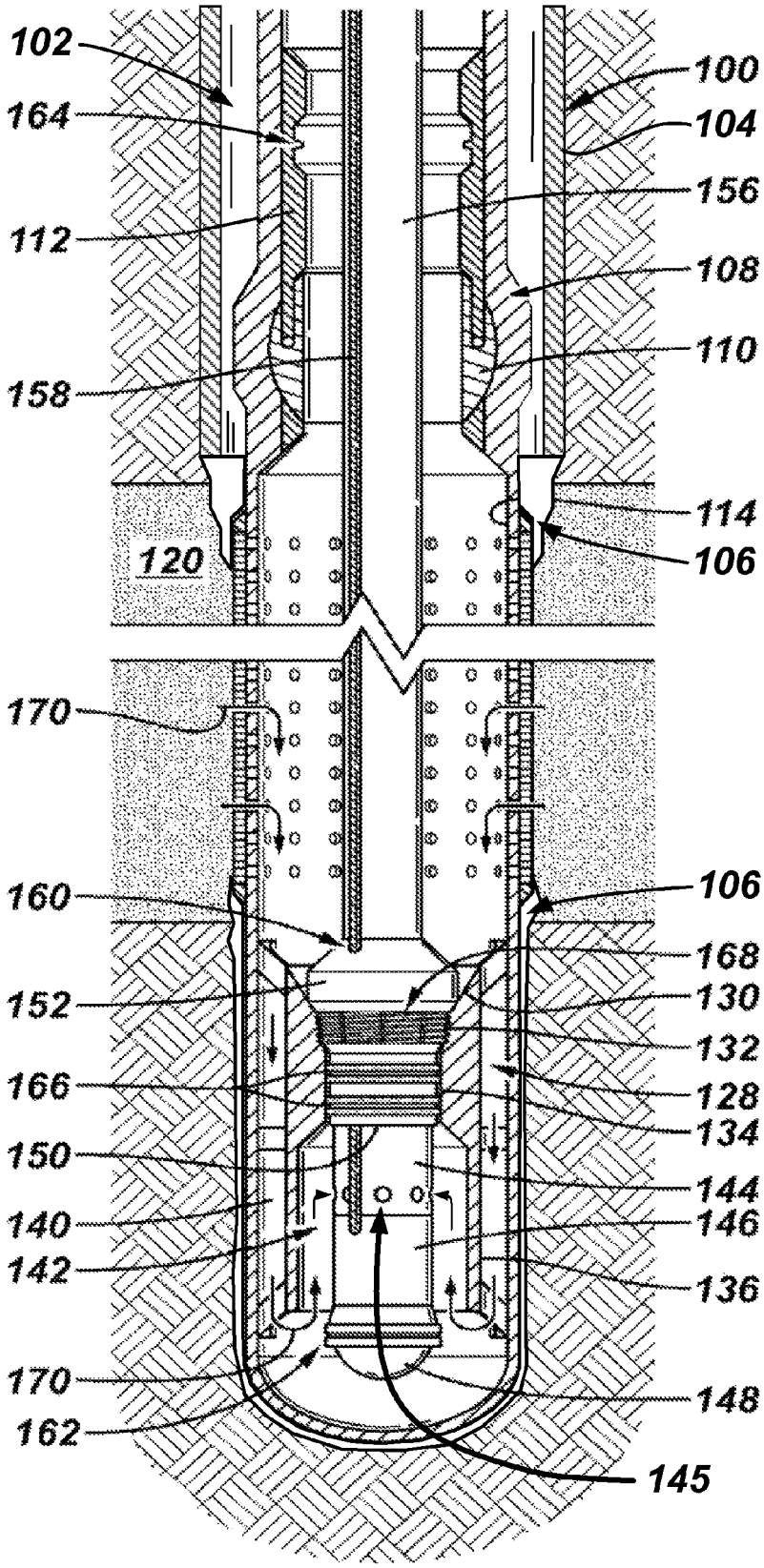
FIG. 3 is a cutaway view of the completion of F*ig*.1 deployed in a wellbore and a pump assembly.

FIG. 3 is a cutaway view of the completion 100 of FIG. 1 and a pump assembly 142 disposed therein. As noted above, the pump assembly 142 may include any known type of fluid pump, including, but not limited to, an electric submersible pump (ESP) or a progressive cavity pump (PCP). In the exemplary embodiment disclosed herein, the pump assembly includes an ESP 144. One exemplary embodiment of an ESP is any of the ESP's commercially available from Schlumberger, Ltd. As shown in Fig. 3, the open wellbore 106 may change shape, for example, during pumping of fluid.

The ESP is driven by an electric motor 146 that is located below the ESP 144, which includes an inlet 145. Below the electric motor 146, at the lowermost end of the pump assembly 142, is an FIV shifting tool 148. Above the ESP 144 is a ported seal assembly 150. Above the ported seal assembly 150 is a snap-latch locator 152. A pipe string 156 extends uphole from the pump assembly 142 to connect the pump assembly 142 to the surface. The pipe string 156 may be constructed of a coiled tubing, jointed pipe, or any other suitable construction as would be recognized by one of ordinary skill in the art. A power cable 158 runs downhole along side the pipe string 156. In an alternative embodiment, the power cable runs downhole inside of the pipe string 156. The power cable 158 is connected downhole to the electric motor 146 and provides electricity to the electric motor 146. So as not to interfere with the connection between the movable pump assembly 142 and the shroud assembly 128, as will be disclosed in greater detail herein, a by-pass port 160 extends through the snap-latch locator 152 and the ported seal assembly 150. The power cable 156 extends through the by-pass port 160 to the electric motor 146. The by-pass port 160 creates a fluid impervious seal around the power cable 158, such that fluid is not transferred through the by-pass port 160.

The FIV shifting tool 148 includes one or more fingers 162. The fingers 162 define a tool profile that matches a collet profile 164 of the FIV 108. The fingers 162 are of a deformable or collapsible construction such that they reversibly deform or collapse when a force is applied greater than a predetermined threshold force. In an alternative embodiment, the fingers 162 may be spring-biased.

The ported seal assembly 150 includes one or more annular seals 166. The annular seals engage the PBR 134 to form at least a fluid resistive seal, and preferably a fluid impervious seal, between the ported seal assembly 150 and the PBR 134. The one or more annular seals 166 can be of a bonded seal type, rubber cup type, or other sealing mechanisms as would be recognized by one of ordinary skill in the art. The snap-latch locator 152 can be of a No-Go type or it can have a latching profile 168 that engages latch profile 132 of the shroud assembly 128. The snap-latch locator 152 ensures that the pump assembly 142 does not move once it is secured within the shroud assembly 128. The latching profile 168 may be a plurality of threads that engage the latch profile 132 of the shroud assembly 128. The threads of the latching profile 168 may be of a deformable or collapsible structure such that the latching profile 168 releases from the latched profile 132 of the shroud assembly 128 once at least a predetermined threshold upward force is applied to the movable pump assembly 142. In one embodiment, the threads of the latching profile 168 are repeatedly deformable or collapsible and in an alternative embodiment, the threads are shearable.

Figure 4:
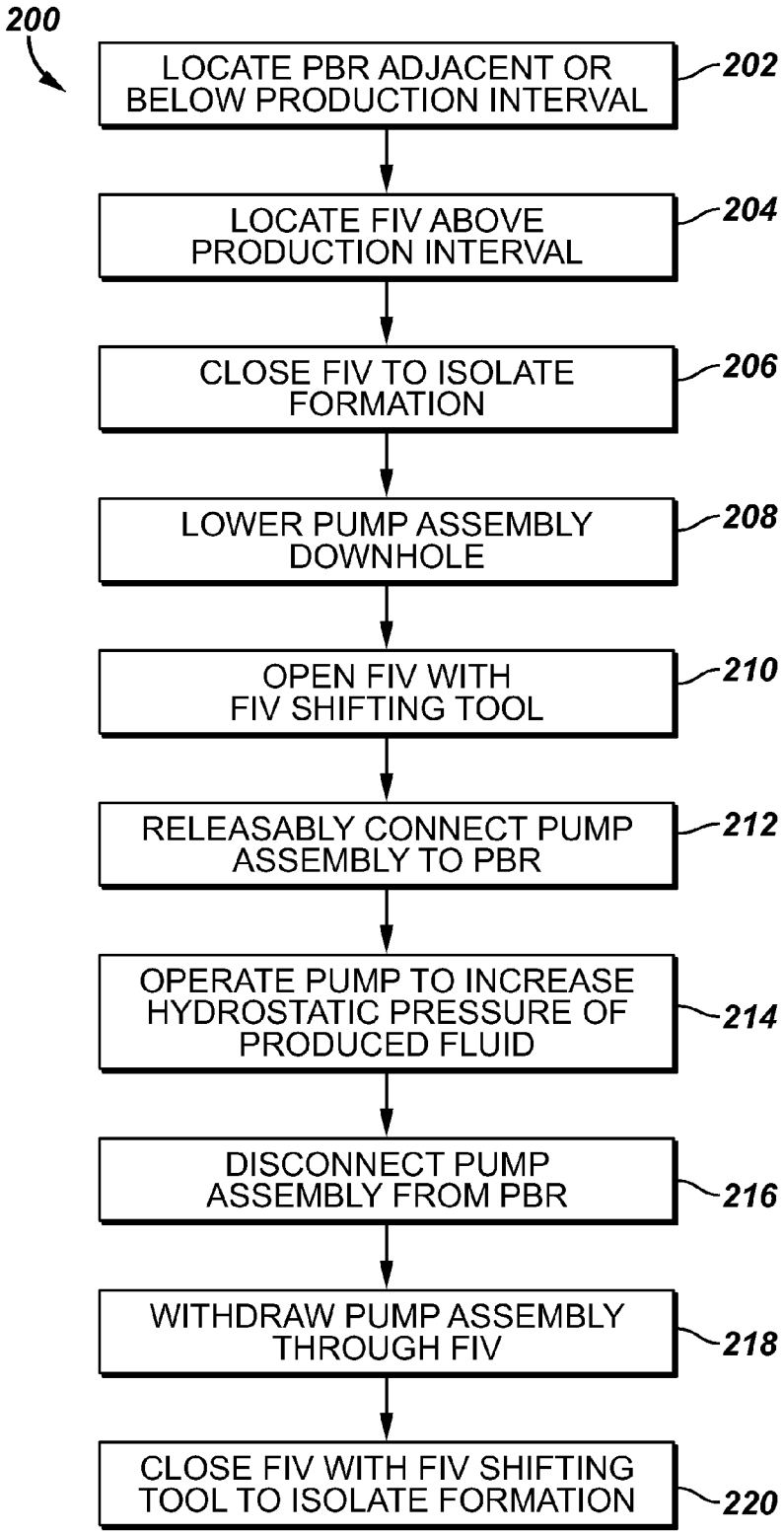
FIG. 4 is a flow chart depicting an embodiment of a method of producing fluid from a hydrocarbon formation.

FIG. 4 is a flow chart depicting a method of producing fluid from a hydrocarbon formation. The operation and use of the structures depicted in FIGS. 1-3 will be described in greater detail herein with respect to the method of FIG. 4. The method 200 begins after a wellbore has been drilled. The wellbore may be a cased wellbore 102, an open wellbore 106, or a combination of a cased wellbore 102 and an open wellbore 106 (as depicted in FIG. 1).

At 202, the PBR 134 is located downhole adjacent to or below a production interval 118 of a hydrocarbon formation 120.

Next, at 204, an FIV 108 is located downhole above the PBR and above the production interval 118.

It is to be understood that in some embodiments, the PBR 134 and the FIV 108 are both components of the completion 100. The completion 100 is pre-assembled and lowered into position within the wellbore as a single unit. Thus, steps 202 and 204 may be performed by locating the completion 100 within the wellbore. The completion 100, including the PBR 134 and the FIV 108, may be secured in place by activating the screen hanger packer 122 of the completion 100. It is further understood that alternative embodiments of the method may include locating additional components of the completion 100. These alternative embodiments may further include locating the production tubing 114 at a location adjacent the production interval 118. The shroud 136 may be located downhole below the PBR 134. In this embodiment, the shroud 136 extends downhole past the production interval 118.

After the completion 100, including the PBR 134 and FIV 108, has been located within the wellbore, the hydrocarbon bearing formation 120 is isolated from producing by closing the FIV at 206. In an embodiment, the completion 100 is located in the wellbore with the FIV 108 already in a closed position. In alternative embodiments, the FIV 108 is located within the wellbore in an open position and after the FIV 108 has been placed in the proper position, then the FIV 108 is moved into a closed position.

Once the formation 120 has been isolated from production by closing the FIV 108, a drilling rig (not depicted), such as was used to drill the wellbore and set the completion 100, may be moved off the well site and the well may be held in this isolated condition until the well is to be produced. The FIV 108, when in the closed position, holds the well in a secure condition that limits any risk of blowout or unnecessary fluid loss into or out of the formation 120.

Next, at 208, when the well is to be produced, a pump assembly 142 is lowered into the well. The pump assembly 142 may be lowered into the well using a workover rig or another smaller rig (not depicted), as would be recognized by one of ordinary skill in the art, which is generally cheaper than using a drilling rig. The pump assembly 142 lowered downhole into the well includes both a pump, such as an ESP 144, and an FIV shifting tool 148.

At 210, the FIV 108 is opened with the FIV shifting tool 148. The FIV shifting tool 148 is located on the lowermost portion of the pump assembly 142. As the FIV shifting tool 148 contacts the collet 112 of the FIV 108, the fingers 162 of the FIV shifting tool 148 collapse such that they fit within the collet 112. The fingers 162 of the FIV shifting tool 148 are arranged to match the collet profile 164 of the collet 112. When the fingers 162 align with the collet profile 164, the fingers 162 return to their original position and releasably lock into the collet profile 164. Continued movement of the pump assembly 142 downhole translates the collet 112 within the FIV 108 such as to move the collet into its lowermost position and simultaneously rotate the ball valve 110 from the closed position (FIG. 1) to the open position (FIG. 3). When the collet 112 has moved into its lowermost position and the ball valve 110 is in a fully open position, continued downward movement of the pump assembly 142 will apply a force on the fingers 162 of the FIV shifting tool 148 such as to meet a threshold force to collapse or otherwise deform the fingers 162 out of engagement with the collet profile 164. After the FIV shifting tool 148 has disengaged from the collet 112, the pump assembly 142 continues downward through the now open FIV 108. The FIV 108 has a drift inside diameter of a sufficient size that the movable pump assembly 142 and the collapsed fingers 162 of the FIV shifting tool 148 can pass completely through the FIV 108.

The pump assembly 142 is then lowered through the production tubing 114 until the pump assembly 142 reaches the shroud assembly 128. The FIV shifting tool 148 contacts the scoop head 130 of the shroud assembly 128. The funnel shape of the scoop head 130 directs the shifting tool 148 (and the rest of the pump assembly 142) to be centered on the shroud assembly 128 and enter the open interior of the PBR 134. At step 212, the pump assembly 142 is releasably connected within the shroud assembly 128. The PBR 143 of the shroud assembly 128 has an inside diameter that is large enough for the FIV shifting tool 148, electric motor 146, and ESP 144 to pass through. However, annular seals 166 of the ported seal assembly 150 form a friction fit with the interior of the PBR 134 such as to form an at least fluid resistive, and preferably fluid impervious seal between the ported seal assembly 150 and the PBR 134.

A latching profile 168 of the snap-latch locator 152 engages the latch profile 132 of the PBR 134. As noted above, the latching profile 168 may be of a collapsible or deformable construction, similar to that of the fingers 162 of the FIV shifting tool 148. The latching profile 168 threadedly engages and secures the movable pump assembly 142 within the shroud assembly 128.

At 214, the ESP 144 is operated to increase the hydrostatic pressure of the produced fluid. During operation of the ESP 144, the electric motor 146 receives energization through the power cable 158 and actuates the ESP 144 to increase the pressure of the hydrostatic head within the pipe string 156. This produces the fluid to the surface in the event that the hydrostatic pressure of the formation 120 is insufficient to produce the fluid to the surface.

The electric motor 146 quickly heats up during operation and therefore produced fluid 170 is directed from the production tubing 114 past the electric motor 146. The fluid impervious seal between the ported seal assembly 150 and the PBR 134 directs the produced fluid 170 into the annular flow area 140 between the shroud 136 and the blank pipe 124. The annular flow area 140 thus creates a flow path wherein the produced fluid 170 must first flow past the electric motor 146 before entering the ESP 144. The continuous flow of produced fluid 170 past the electric motor 146, cools the electric motor 146 improving the operational efficiency and lifespan of the electric motor 146.

Often during the production life of a well, the ESP 144 or electric motor 146 must be replaced. Alternatively, production may be intermittently stopped due to market, weather, maintenance, or other reasons. When production is stopped for any of these reasons, the formation 120 must be isolated by closure of the FIV 108. In any of these events, the pump assembly 142 is removed from the shroud assembly 128 and retracted up the wellbore.

As previously noted, the latching profile 168 of the pump assembly 142 may be deformable, collapsible, or shearable. At 216, the pump assembly 142 is disconnected from the PBR 134 by applying a predetermined threshold level of upward force to the pump assembly 142. This disconnects latching profile 168 of the snap-latch locator 152 from the latch profile 132 of the PBR 134. Continued uphole movement of the movable pump assembly 142 disengages the fluid impervious seal between the ported seal assembly 150 and the PBR 134. The ESP 144, electric motor 146, and FIV shifting tool 148 are withdrawn from the shroud assembly 128 through the PBR 134.

At 218, the pump assembly 142 is withdrawn through the open FIV 108. The FIV 108 coaxially receives the pump assembly 142. The fingers 162 of the FIV shifting tool 148 collapse or deform to fit within the inside diameter of the FIV 108. Once the fingers 162 again align with the collet profile 164 of the FIV 108, the fingers 162 expand to engage the collet profile 164.

At 220, the FIV 108 is closed with the FIV shifting tool 148 to isolate the formation 120. Uphole movement of the pump assembly 142 is translated to the collet 112 through the engagement of the shifting tool with the collet profile 164. This upwardly translates the collet 112 which moves the ball valve 110 of the FIV 108 from the open position to the closed position. Once the collet 112 is moved into an uppermost position, in which the ball valve 110 is in the fully closed position, continued upward force is applied to the pump assembly 142 and when the upward force exceeds the predetermined threshold, the fingers 162 deform or collapse, releasing the FIV shifting tool 148 from the collet 112. The pump assembly 142 is then retrieved from the wellbore with the formation 120 now in isolation due to the closed FIV 108.

Embodiments of the system, device, and method disclosed herein may be advantageously used in the production of hydrocarbon fluids as the ESP is located at a position below the production interval and therefore hydrocarbons may be produced from a formation, even when the hydrostatic pressure of the formation is insufficient to produce the fluid above the production interval. Since the electric motor is cooled by produced fluid, the produced fluid must be directed downhole of the ESP, such as by the shroud that forms the annular flow area. Since the shroud has a greater outside diameter than the inside diameter of the FIV, the shroud (and shroud assembly) is placed in the wellbore as a part of the completion and the pump assembly is removably connected to the shroud assembly.

The embodiments of the system, device, and method described above provide examples of systems, devices, and methods that utilize a pump to increase the hydrostatic head of fluid produced from a well.

Accordingly, although only a few embodiments of the system, device, and method have been disclosed in detail above, those of ordinary skill in the art will readily appreciate that many modifications are possible without materially departing from the teachings of this disclosure. Such modifications are intended to be included within the scope of the system, device, and method as defined in the claims.

What is claimed is:

1. A system for producing a fluid through a completion in a well, the system comprising:

a formation isolation valve located in the completion above a production interval of the well;

a shroud assembly including a shroud and a polished bore receptacle, the shroud assembly located in the completion below the formation isolation valve and adjacent or below the production interval;

a moveable pump assembly, including a pump and an electric motor that supplies power to the pump, the pump assembly releasably connects with the shroud assembly such that the pump assembly is at least partially disposed within the shroud assembly and the shroud assembly extends below the electric motor; and a shifting tool connected to the movable pump assembly below the electric motor, the shifting tool configured to engage a collet profile of the formation isolation valve;

wherein the formation isolation valve is operable between an open position and a closed position when the shifting tool engages the collet profile.

2. The system of claim 1, wherein the shifting tool engages the collet profile when the formation isolation valve is in the closed position and downward movement of the pump assembly moves the formation isolation valve from the closed position to the open position, and further downward movement of the pump assembly disengages the shifting tool from the collet profile and moves the pump assembly through the open formation isolation valve.

3. The system of claim 2, wherein:

the pump assembly moves upward through the formation isolation valve in the open position and the shifting tool engages the collet profile of the formation isolation valve;

wherein further upward movement of the pump assembly moves the formation isolation valve from the open position to the closed position; and wherein still further upward movement of the pump assembly disengages the shifting tool from the collet profile.

4. The system of claim 1, further comprising:

a scoop-head connected to the shroud assembly, the scoop-head forming a frustum between the completion and the polished bore receptacle;

a latch assembly connected between the scoop-head and the polished bore receptacle, the latch assembly releasably connects to the pump assembly.

5. The system of claim 4, wherein the pump assembly further comprises a seal assembly and the seal assembly engages the latch assembly to connect the shroud assembly to the pump assembly, the seal assembly further forms a fluid impervious seal between the pump assembly and the shroud assembly above the pump.

6. The system of claim 5, further comprising a power cable that extends downhole from the surface and connects to the electric motor, wherein the power cable extends through a power cable bypass through the seal assembly.

7. The system of claim 6, wherein the shroud is connected to the completion by a plurality of radial supports, the connection of the shroud to the completion defines an annular flow area radially outward from the shroud and radially inward from the completion, wherein the annular flow area directs the fluid downhole of the shroud.

8. The system of claim 4, further comprising a sand screen connected to the formation isolation valve and the shroud assembly, the sand screen located in the completion adjacent to the production interval.

9. The system of claim 8, further comprising a blank pipe connected to the sand screen, the blank pipe connected to and coaxial with the shroud assembly, the blank pipe terminating in a plug, wherein the blank pipe and the shroud assembly define an annular flow area between the shroud assembly and the blank pipe.

10. A pump assembly, comprising:

a snap-latch locator configured to releasably engage a polished bore receptacle of a well completion to releasably secure the pump assembly coaxially within the polished bore receptacle;

a ported seal assembly configured to engage the polished bore receptacle to form a fluid seal between the ported seal assembly and the polished bore receptacle;

a fluid pump connected below the ported seal assembly, the fluid pump comprising an inlet;

an electric motor connected below the fluid pump, and operatively connected to the fluid pump to provide actuation of the fluid pump;

a shifting tool connected below the electric motor for operating a formation isolation valve for downhole passage of at least the electric motor therethrough, the shifting tool configured to engage a collet profile of the formation isolation valve; and a power cable that extends through the ported seal assembly and connects to the electric motor to provide energization to the electric motor.

11. The electric pump of claim 10, wherein the fluid pump is a progressive cavity pump.

12. The electric pump of clam 10, wherein the fluid pump is an electric submersible pump.

13. The electric pump of claim 12, wherein the snap-latch locator comprises a plurality of threads that releasably engage the polished bore receptacle.

14. The electric pump of claim 13, wherein the plurality of threads release engagement with the polished bore receptacle upon the application of a predetermined upward force.

15. A method of producing fluid from a hydrocarbon formation through a wellbore, the method comprising:

locating a polished bore receptacle downhole at a location adjacent or below a production interval of the hydrocarbon formation;

locating a formation isolation valve downhole above the polished bore receptacle and above the production interval;

isolating the formation with the formation isolation valve;

lowering a pump assembly downhole, the pump assembly comprising a shifting tool and a latch assembly;

opening the formation isolation valve with the shifting tool;

passing the pump assembly through the formation isolation valve;

releasably engaging the pump assembly within the polished bore receptacle with the latch assembly.

16. The method of claim 15, wherein the pump assembly further comprises a fluid pump and an electric motor, and further comprising:

operating the electric motor and the fluid pumps to increase a hydrostatic pressure within the wellbore sufficient to produce fluid to a surface.

17. The method of claim 16, wherein the polished bore receptacle further comprises a shroud that defines a flowpath for produced fluid from the hydrocarbon formation to the fluid pump, the electric motor located below the fluid pump, and comprising:

producing fluid from the hydrocarbon formation; and directing the fluid along the flowpath past the electric motor to cool the electric motor.

18. The method of claim 17, wherein the pump assembly further comprises a seal assembly and further comprising:

engaging the polished bore receptacle with the seal assembly to create a fluid seal;

wherein the fluid seal directs produced fluid into the flowpath.

19. The method of claim 15, further comprising:

disengaging the pump assembly from the polish bore receptacle;

withdrawing the pump assembly through the formation isolation valve;

closing the isolation valve with the shifting tool; and withdrawing the pump assembly from the wellbore.

* * * * *